US007506728B2

(12) United States Patent
Hawkes et al.

(10) Patent No.: US 7,506,728 B2
(45) Date of Patent: Mar. 24, 2009

(54) ELECTRICAL CONNECTOR DEVICE FOR USE WITH ELEVATOR LOAD BEARING MEMBERS

(75) Inventors: Justin R. Hawkes, Vernon, CT (US); Fred Lussier, Hebron, CT (US); Paul A. Stucky, Stockton, CA (US); William A. Veronesi, Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 445 days.

(21) Appl. No.: 10/598,225

(22) PCT Filed: Mar. 16, 2004

(86) PCT No.: PCT/US2004/007902

§ 371 (c)(1),
(2), (4) Date: Aug. 22, 2006

(87) PCT Pub. No.: WO2005/095253

PCT Pub. Date: Oct. 13, 2005

(65) Prior Publication Data

US 2008/0190709 A1 Aug. 14, 2008

(51) Int. Cl.
*B66B 7/08* (2006.01)

(52) U.S. Cl. ..... 187/411; 187/277

(58) Field of Classification Search ..... 187/247, 187/248, 277, 251, 261, 264, 411, 412, 413; 73/282, 831, 832, 839, 862.56; 57/210, 211, 57/212, 218, 221, 232, 237, 241; 439/425
See application file for complete search history.

(56) References Cited

U.S. PATENT DOCUMENTS

| | | | | |
|---|---|---|---|---|
| 4,427,940 | A * | 1/1984 | Hirama et al. | 324/240 |
| 5,321,356 | A * | 6/1994 | Weischedel | 324/262 |
| 5,414,353 | A * | 5/1995 | Weischedel | 324/232 |
| 5,834,942 | A * | 11/1998 | De Angelis | 324/522 |
| 6,073,728 | A * | 6/2000 | Olsen et al. | 187/414 |
| 6,123,176 | A * | 9/2000 | O'Donnell et al. | 187/393 |
| 6,289,742 | B1 * | 9/2001 | De Angelis | 73/835 |
| 6,295,799 | B1 | 10/2001 | Baranda | |
| 6,608,487 | B2 | 8/2003 | De Angelis | |

(Continued)

FOREIGN PATENT DOCUMENTS

DE 39 34 654 A1 5/1991

OTHER PUBLICATIONS

International Search Report for Application No. PCT/US04/07902, mailed Dec. 21, 2004.

(Continued)

*Primary Examiner*—Jonathan Salata
(74) *Attorney, Agent, or Firm*—Carlson, Gaskey & Olds

(57) ABSTRACT

A connector device (40) for making electrically conductive connections with at least one tension member (32) in an elevator load bearing member (30) includes a spacer member (42) that establishes physical spacing between portions (38) of the load bearing member (30). In one example, each portion (38) includes one tension member (32). A holding member (50) secures the portions (38) in a selected position relative to the connector device. At least one electrically conductive connector member (70) makes electrically conductive contact with at least one of the tension members (32) to facilitate a selected electricity-based monitoring technique for accessing the condition of the load bearing member.

20 Claims, 6 Drawing Sheets

U.S. PATENT DOCUMENTS

| | | | | |
|---|---|---|---|---|
| 6,653,943 | B2 | 11/2003 | Lamb et al. | |
| 7,409,870 | B2 * | 8/2008 | Stucky et al. | 73/810 |
| 7,410,033 | B2 * | 8/2008 | Veronesi et al. | 187/391 |
| 2007/0180925 | A1 * | 8/2007 | Stucky et al. | 73/810 |
| 2008/0223668 | A1 * | 9/2008 | Stucky et al. | 187/393 |

OTHER PUBLICATIONS

Written Opinion of the International Searching Authority for Application No. PCT/US04/07902, mailed Dec. 21, 2004.
International Preliminary Report on Patentability for Application No. PCT/US04/07902, completed May 5, 2005.

* cited by examiner

ELECTRICAL CONNECTOR DEVICE FOR USE WITH ELEVATOR LOAD BEARING MEMBERS

FIELD OF THE INVENTION

This invention generally relates to electrical connectors for making a conductive connection with at least one tension member in an elevator load bearing member.

DESCRIPTION OF THE RELATED ART

Elevator systems typically include a load bearing member such as a rope or belt that bears the weight of the car and counterweight and allows the car to be moved as desired within the hoistway. For many years, steel ropes were used. More recently, coated steel belts have been introduced that include a plurality of tension members encased within a jacket. In one example, the tension members are steel cords and the jacket comprises a polyurethane material.

The new arrangements present new challenges for monitoring the load bearing capabilities of the belt assembly over the life of the elevator system.

A variety of techniques for monitoring modern elevator belts are being developed. This invention provides the ability to readily and accurately establish an electrically conductive connection with at least one of the tension members to facilitate an electricity-based monitoring technique.

SUMMARY OF THE INVENTION

In general terms, this invention is a device for making an electrical connection with at least one tension member of an elevator load bearing member.

One example device includes a spacer member that establishes physical spacing between tension members within the load bearing member. A holding member holds portions of the tension members in a selected position relative to the spacer member. At least one electrical connector member is supported by the spacer or the holding member. The electrical connector member is adapted to make electrically conductive contact with at least one of the tension members. that maintain spacing between adjacent tension members on one side of the spacer member.

An example method of making an electrical connection includes longitudinally separating portions of the jacket covering over the tension members in a longitudinal direction along a portion of the length of the load bearing member. In one example, the jacket material is cut. Once separated, the jacket with the individually encased tension member portions is manipulated to establish the desired physical spacing between the portions to facilitate making electrical contact with at least one of the tension members.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
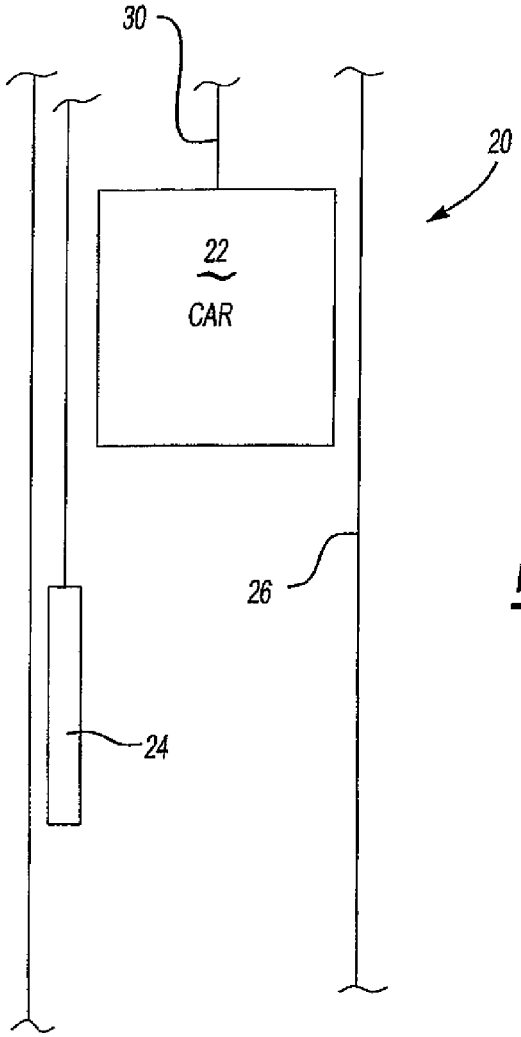
FIG. 1 schematically illustrates selected portions of an elevator system.

FIG. 1 schematically illustrates selected portions of an elevator system 20. A car 22 moves with a counterweight 24 within a hoistway 26 in a conventional manner. A load bearing member 30 supports the weight of the car 22 and counterweight 24 and interacts with at least one drive sheave of a machine (not illustrated) to cause the desired movement of the car and counterweight within the hoistway.

Figure 2:
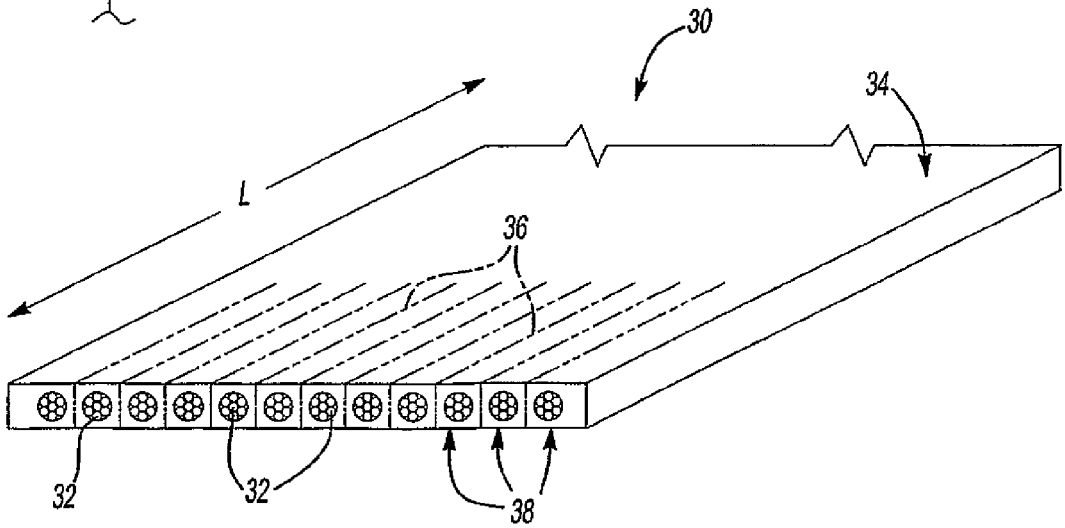
FIG. 2 schematically illustrates selected features of an elevator belt with which an example embodiment of a connector device designed according to this invention can be used.

FIG. 2 schematically illustrates a portion of one example load bearing member 30, which is a coated steel belt. The example of FIG. 2 is for discussion purposes and this invention is not necessarily limited to a particular style of belt or load bearing member. In this example, a plurality of tension members 32 extend longitudinally (i.e., the direction L shown in FIG. 2) within the belt 30. In one example, the tension members 32 each comprise steel strands that are wound into a cord in a conventional manner.

The tension members 32 are encased in a jacket 34, which in one example comprises a polyurethane material. As schematically shown at 36, and for reasons to be described below, a selected length of the belt 30 is separated in a longitudinal direction to divide it into a plurality of discrete portions 38. Each portion 38 includes a corresponding portion of one of the tension members 32. In one example, the portions 38 are separated by cutting through the material of the jacket 34. In one example, this is accomplished using a manual cutting tool at the location where the belt is placed in service in an elevator system. Of course, other techniques for separating a selected length of the belt 30 into discrete portions are within the scope of this invention and the term separating should be construed to cover breaking, splitting, cutting, etc.

For situations where it is desirable to monitor the condition of the belt 30 using an electricity-based monitoring technique, this invention provides a unique connection device and technique that facilitates accurate and secure electrical connections with the tension members 32 of the belt 30.

FIGS. 3-6 schematically illustrate one example connector device 40 designed according to this invention. A spacer member 42 establishes physical spacing between the portions 38 of the pre-split belt 30. In this example, the spacer member 42 includes a plurality of bosses 44 that are received between portions 38 of the belt. In this example, one end 46 of the spacer includes obliquely oriented surfaces that facilitate inserting the spacer between selected portions 38 of the belt. In the illustrated example, the obliquely oriented surfaces of the end 46 are rounded to facilitate a more smooth insertion of the spacer member 42 into the selected position.

In this example, the spacer member 42 has a body with oppositely facing sides 48 and 49. As can be appreciated from the drawings, alternating portions 38 are received on opposite sides 48, 49 of the spacer member body. The bosses 44 in this example are provided on both sides 48 and 49 of the spacer member body.

The connecting device 40 also includes a holding member 50. In this example, the holding member 50 has a portion that is received on both sides of the spacer member 40. The holding member 50 holds the belt portions 38 in a selected position relative to the spacer member 42. More particularly, a first portion 52 of the holding member 50 is received against the portions 38A of the belt that are received against the side 48 of the spacer member body. A second holding portion 54 is received against the portions 38B of the belt, which are received against the side 49 of the spacer member 42.

Each of the portions 52 and 54 of the holding member 50 are connected with the spacer 42 in this example by plastic hinges 56. The portions 52 and 54 of the holding member are manually manipulatable into the position illustrated in the figures to secure the portions 38 of the belt in the desired orientation relative to the spacer member 42. Latch members 58 are provided, in this example, on each of the holding member portions 52 and 54. The spacer member 42 has locking surfaces 60 that cooperate with a latching portion 62 of the latch members 58 to secure the connector device 40 in place with the belt 30. Of course, other variations are within the scope of this invention. One example includes a threaded member that secures the portions 52, 54 and the spacer in place.

Figure 5:
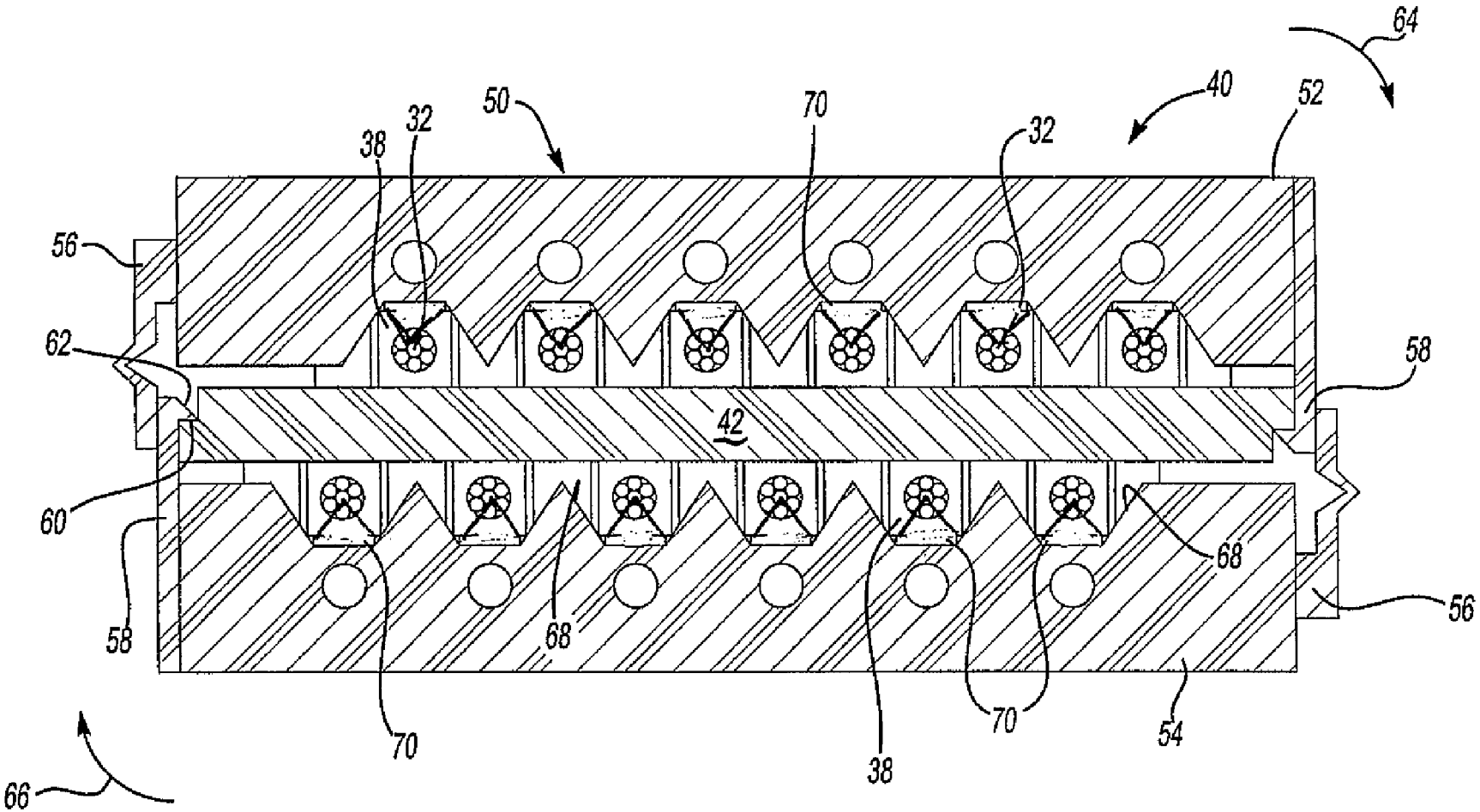
FIG. 5 is a cross-sectional illustration taken along the lines 5-5 in FIG. 3.

As best appreciated from FIG. 5, once the spacer member 42 is inserted in place relative to the portions 38 of the belt, the clip portions 52 and 54 can be moved according to the arrows 64 and 66 in FIG. 5 into the locked position shown. The illustrated example includes obliquely oriented guide surfaces 68 that facilitate moving the portions 38 into a centered position between the guide surfaces as the portions 52 and 54 are manipulated into the locked position shown. The guide surfaces 68 facilitate centering the portions 38 into a desired alignment with electrically conductive connector members 70, which in this example are supported on the portions of the holding member 50.

A significant advantage of a connector device designed according to this invention is that it is better able to consistently establish a desired electrical connection with the tension members of the belt. Any variations in the position of the tension members within the jacket are accommodated by the division of the belt portions 38 and the physical spacing between them. In the example of FIG. 5, the guide surfaces further facilitate accurately aligning the electrically conductive connector members 70 with the individual tension members 32 such that an appropriate electrical connection is established. In the illustrated examples, the spacer member maintains adequate spacing to avoid any misconnections between each connector member 70 and the appropriate tension member 32.

In one example, the electrically conductive connector members include sharp terminal edges that penetrate through the jacket material 34 and make electrical contact with the tension members 32. In one example, the connector members 70 also penetrate through at least a portion of the tension members 32 as best appreciated from FIG. 6.

Forcing the connector members through the jacket material may be accomplished during the process of manipulating the holding member portions 52 and 54 into the positions shown. Alternatively, separately forcing the connector members into the conductive position may be accomplished before or after the holding member is locked in place.

Figure 6:
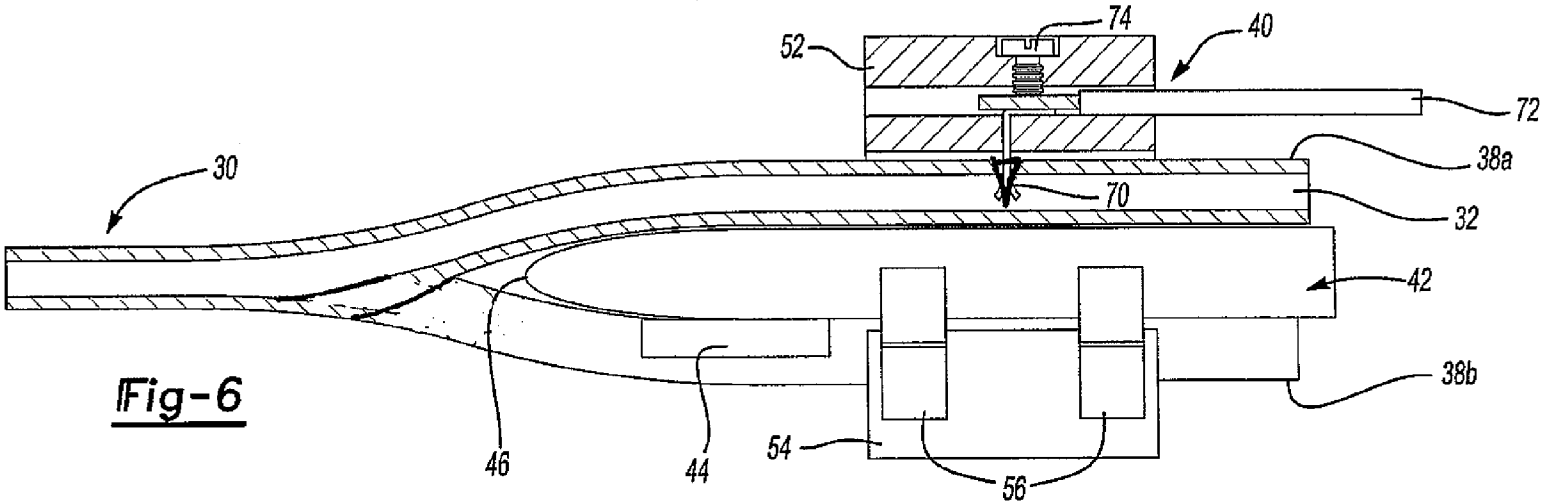
FIG. 6 is a cross-sectional illustration taken along the lines 6-6 in FIG. 3.

As shown in FIG. 6, a connection between an example connector member 70 and a conductive wire 72 is accomplished using a threaded connecting member 74. Such a connection can be made before or after the connector device 40 is secured in place relative to the portions 38 of the belt. The wire 72 facilitates communicating electrical power, signals or both to the tension member 32 according to a desired monitoring protocol.

Figure 7:
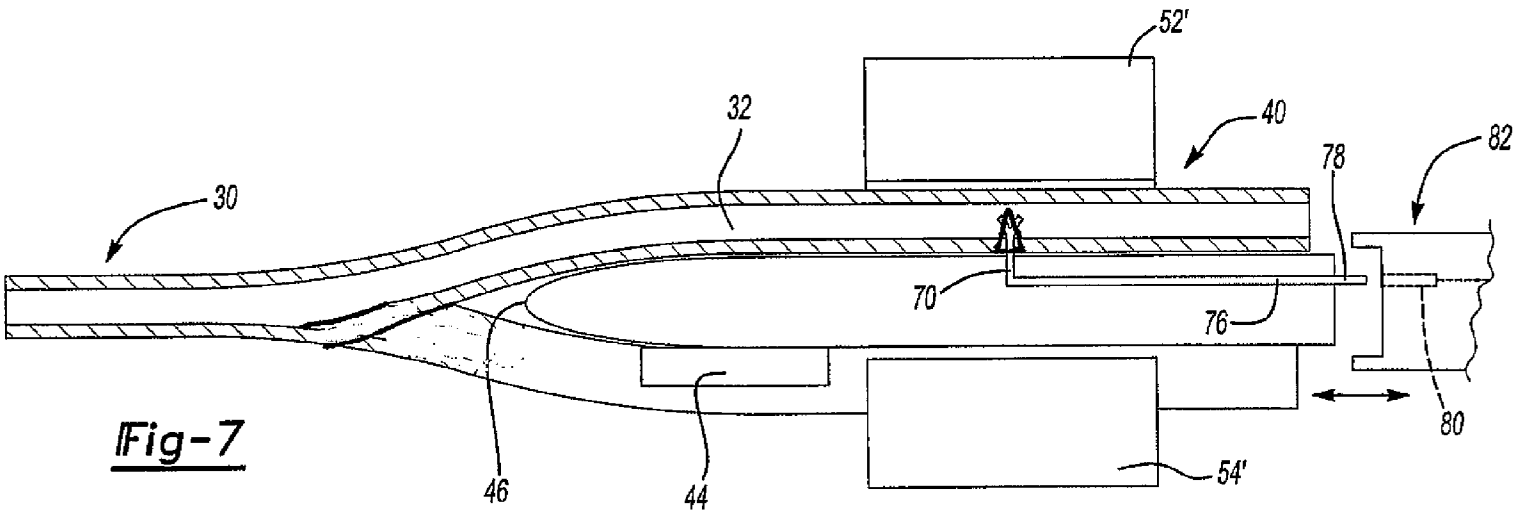
FIG. 7 is a cross-sectional illustration similar to that in FIG. 6, showing an alternative embodiment.

An alternative embodiment is shown in FIG. 7 where the electrically conductive connector members 70 are supported in the spacer member 42 rather than in the holding member 50. One advantage to such an arrangement is that conductive leads 76 associated with the connector member 70 can be positioned for convenient connection with an electrical connector to facilitate connections between the device 40 and other electronics, for example. In the example of FIG. 7, a male end 78 on the connective lead 76 is selectively received in a female connector 80 of a connection port 82 that is selectively coupled with the connector device 40. A variety of strategies for orienting the connector members and establishing electrical connections with other devices are within the scope of this invention. Those skilled in the art who have the benefit of this description will be able to select an arrangement that best meets the needs of their particular situation.

Figure 3:
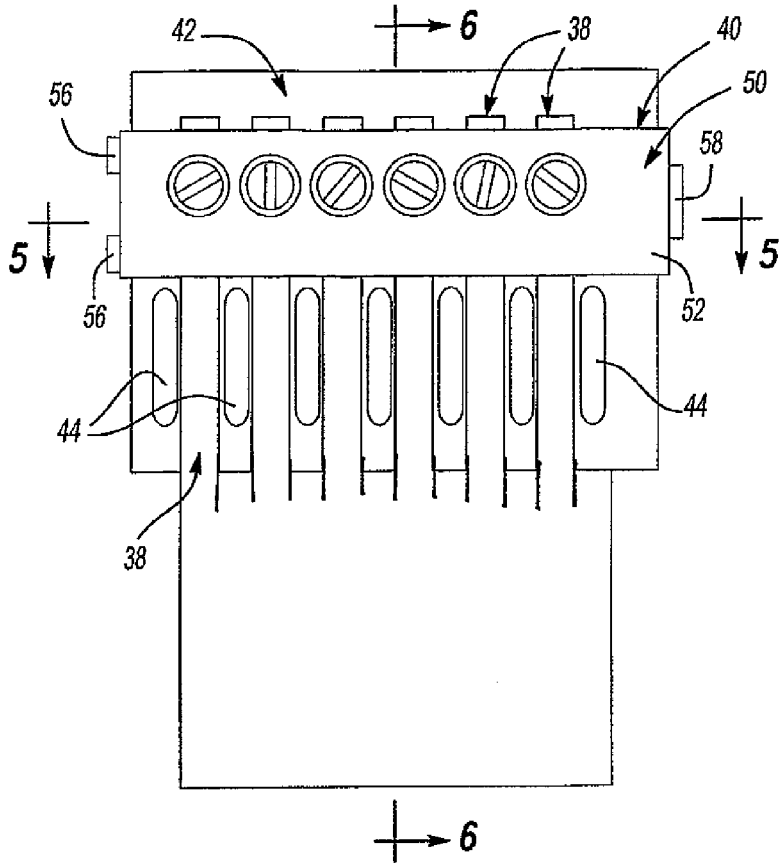
FIG. 3 is a top elevational view of one example embodiment connector device designed according to this invention.
Figure 4:
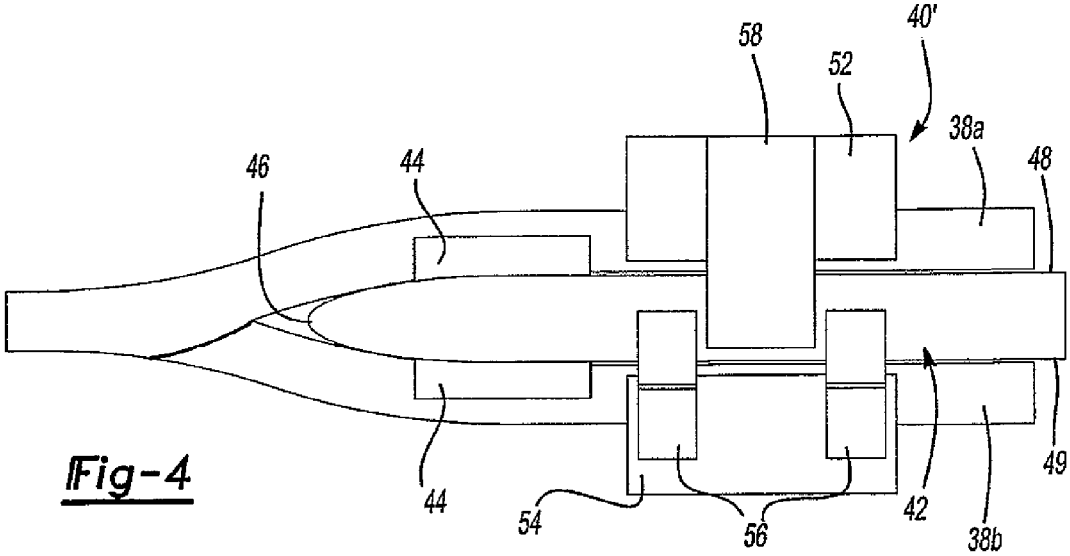
FIG. 4 is a side view of the embodiment of FIG. 3.
Figure 8:
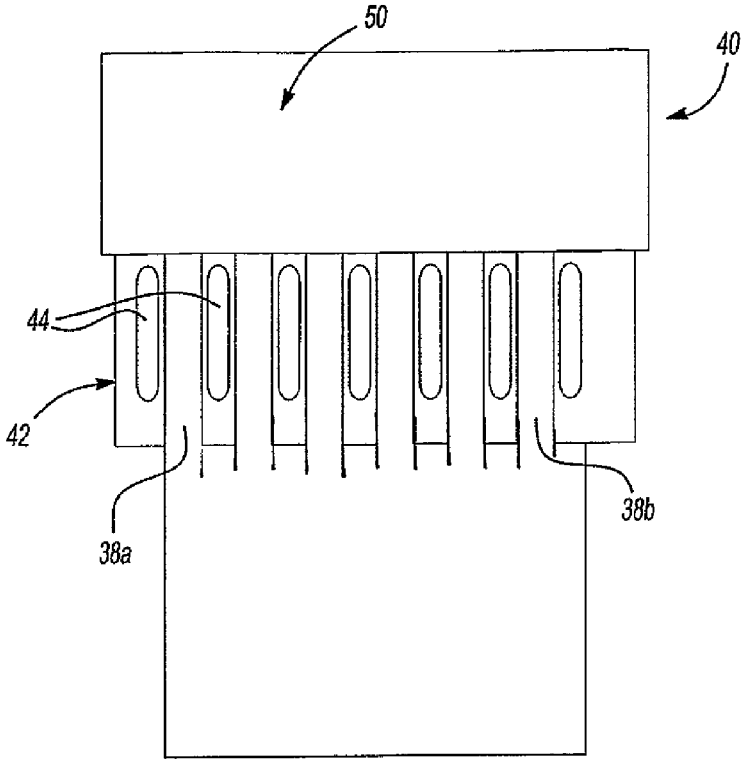
FIG. 8 is a top elevational view of an alternative embodiment of a connector device designed according to this invention.
Figure 9:
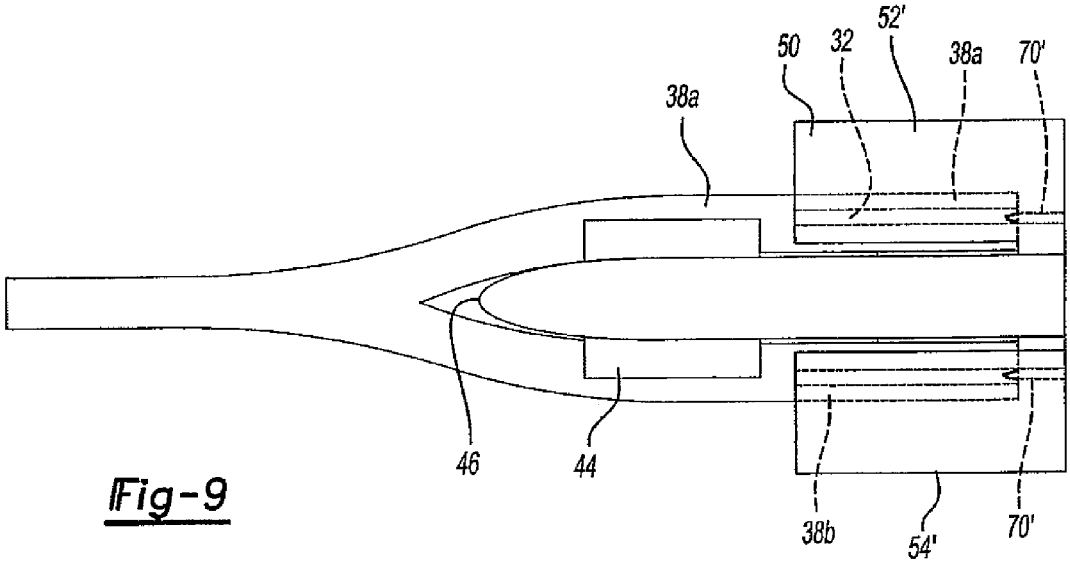
FIG. 9 is a side view of the embodiment of FIG. 8 schematically illustrating a connection feature.

Another example embodiment is shown in FIGS. 8 and 9. In this example, the spacer member 42 is received amongst the portions 38 of the belt such that some of the portions 38A are received on one side of the spacer and some 38B are received on the other side similar to the embodiment of FIG. 3. A difference between this example and the example of FIG. 3 is that the electrically conductive connector members 70' are received into an end of the tension members 32 rather than intersecting them as was accomplished in the previous embodiments. One advantage to such an arrangement as shown in FIGS. 8 and 9 is that the jacket material 34 need not be penetrated by the electrically conductive connector members 70'. This may facilitate more readily accomplished connections, depending on the materials selected for the belt, for example. Further, the orientation of the connector members 70' facilitates making a plug-in type connection as schematically illustrated in FIG. 7, for example.

Figure 10:
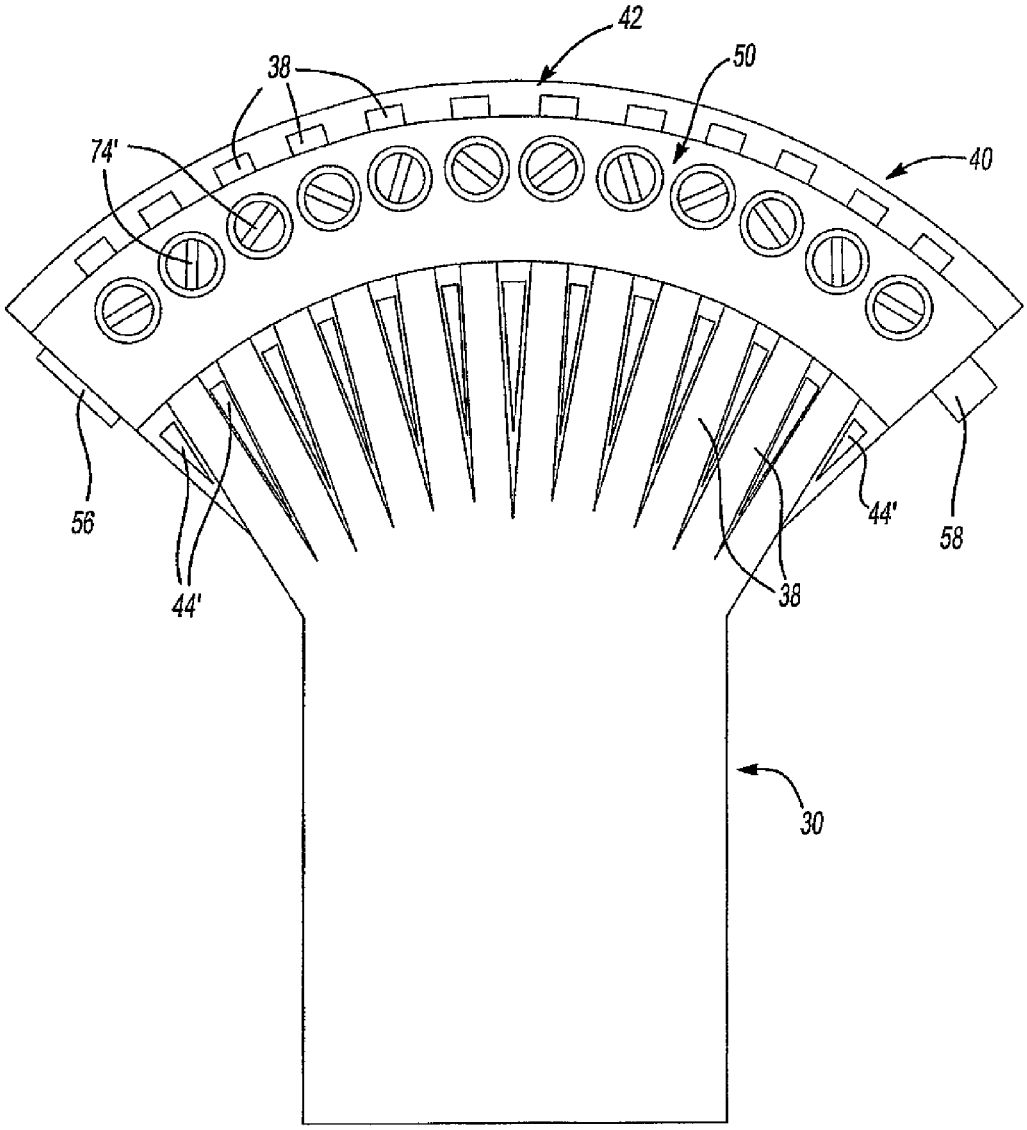
FIG. 10 is a top elevational view of another embodiment of a connector device designed according to this invention.
Figure 11:
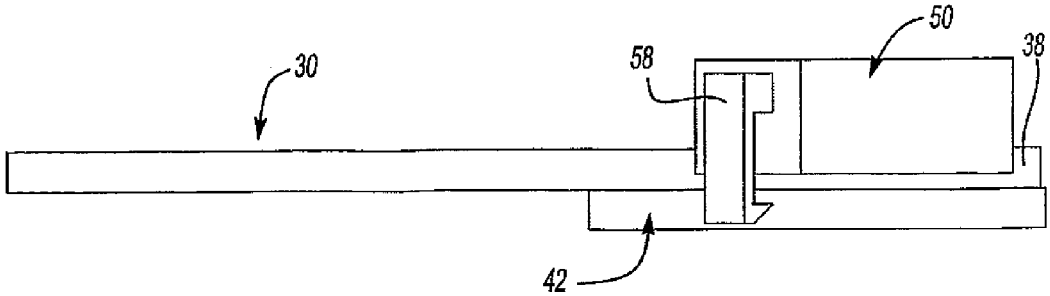
FIG. 11 is a side view of the embodiment of FIG. 10.

Another example embodiment is shown in FIGS. 10 and 11. In this example, the connector device 40 has a spacer member 42 that receives all of the portions 38 of the belt 30 on one side of the body of the spacer member 42. In this example, the bosses 44' have obliquely oriented surfaces that facilitate inserting the spacer member into position relative to the portions 38. The bosses 44' facilitate maintaining a desired physical spacing between the portions 38. The holding member 50 in this example is received on only one side of the spacer member 42. A plastic hinge 56 and locking mechanism 58 facilitate securing the holding member relative to the spacer member similar to the embodiment described above. In this example, threaded connecting members 74' facilitate making a connection between the electrically connective connector members that contact the tension members 32 and outside electronics, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for making electrical contact with at least one tension member in a load bearing member used in an elevator system, comprising:

a spacer member that establishes physical spacing between portions of the tension members;

a holding member that holds the portions in a selected position relative to the spacer member; and at least one electrical connector member supported by at least one of the spacer members or the holding member, the connector member being adapted to make electrically conductive contact with at least one of the tension members.

2. The device of claim 1, wherein the spacer member has a body that receives a first tension member on a first side of the body and a second tension member on a second, oppositely facing side of the body.

3. The device of claim 2, wherein the spacer member has at least one boss on at least one of the sides that receives a tension member on one side of the boss and another tension member on another side.

4. The device of claim 2, including a holding member associated with each of the first and second sides of the body.

5. The device of claim 4, wherein each holding member is moveably attached to the body and including a latch that secures each holding member in position to hold the portions in the selected positions.

6. The device of claim 1, including at least one boss that receives one tension member on one side of the boss and another tension member on another side of the boss.

7. The device of claim 6, wherein the spacer member has a body and all of the tension members are received on one side of the body.

8. The device of claim 1, wherein the electrical connector has an engaging surface that is adapted to penetrate at least partially through a coating over the tension member to thereby make the electrically conductive contact.

9. The device of claim 1 wherein the electrical connector is oriented relative to the device such that the connector contacts a distal end of the tension member when the tension member portion is positioned between the spacer and holder members.

10. The device of claim 1, wherein the spacer member has obliquely oriented surfaces that facilitate manipulating the spacer member between the portions.

11. The device of claim 1, wherein at least one of the holder member or the spacer member includes guide surfaces that facilitate centering at least one of the portions in a desired position relative to the connector member.

12. The device of claim 1, including a plurality of connector members.

13. A method of establishing an electrically conductive contact with at least one tension member in a load bearing member used in an elevator system, comprising:

separating a selected length of the load bearing member into discrete portions each having a tension member;

inserting a spacer between the portions; and securing a conductive connector member to at least one of the tension members.

14. The method of claim 13, wherein the load bearing member has a coating over the tension members and including separating the coating adjacent the tension member portions before inserting the spacer.

15. The method of claim 14, including cutting the coating in a longitudinal direction generally parallel to a length of the tension member portions.

16. The method of claim 13, wherein the load bearing member has a nonconductive coating over the tension members and including forcing at least a part of the conductive connector member through the coating into contact with the at least one tension member.

17. The method of claim 16, including forcing at least a terminal end of the connector member into the tension member.

18. The method of claim 13, including coupling a holder member with the spacer member to secure the belt portions in a selected position relative to the spacer.

19. The method of claim 13, including positioning the separated portions on one side of the spacer member.

20. The method of claim 13, including positioning at least one of the portions on one side of the spacer member and at least one other of the portions on an opposite side of the spacer member.

* * * * *